US006915818B2

(12) United States Patent
Burris et al.

(10) Patent No.: US 6,915,818 B2
(45) Date of Patent: Jul. 12, 2005

(54) FLOATING ARM PICK UP DEVICE

(75) Inventors: Steven Y Burris, Charleston, SC (US); Charles A. Perry, IV, Cleveland, GA (US)

(73) Assignee: Fuel Delivery Systems, LLC, Cleveland, GA (US)

( * ) Notice: Subject to any disclaimer, the term of this patent is extended or adjusted under 35 U.S.C. 154(b) by 0 days.

(21) Appl. No.: 10/793,069

(22) Filed: Mar. 4, 2004

(65) Prior Publication Data

US 2004/0173266 A1 Sep. 9, 2004

Related U.S. Application Data

(60) Provisional application No. 60/452,990, filed on Mar. 7, 2003.

(51) Int. Cl.[7] ..... E03B 3/18; E03B 11/00

(52) U.S. Cl. ..... 137/544; 137/549; 137/578; 137/590; 210/242.1

(58) Field of Search ..... 137/578, 590, 137/544, 545, 549; 210/242.1

(56) References Cited

U.S. PATENT DOCUMENTS 558,131 A * 4/1896 Warren ..... 210/242.1
781,093 A * 1/1905 Post ..... 405/88
836,335 A * 11/1906 Nichols ..... 210/242.1
1,064,102 A * 6/1913 Smith et al. ..... 261/120
1,528,003 A * 3/1925 Yarnall ..... 137/578
3,381,709 A * 5/1968 Pregno ..... 137/578
3,438,215 A * 4/1969 Willem ..... 62/45.1

* cited by examiner

*Primary Examiner*—A. Michael Chambers
(74) *Attorney, Agent, or Firm*—Troutman Sanders LLP; Ryan A. Schneider

(57) ABSTRACT

A fluid pick up device for removing fluid from storage tanks includes an intake, a submerging member that maintains the intake submerged in the fluid, and a float that enables the intake to move in relationship to the level of fluid. The submerging member can include an extension communicating with the intake. The extension can be an adjustable arm connected to a delivery member by a swivel joint. A stopping member can control the arm's range of motion. The intake is angled downward, and the length of the arm is set to prevent the intake from passing into a contaminated volume of fluid near the tank bottom. The intake can also be movable. The adjustable arm can retract into the delivery member.

17 Claims, 7 Drawing Sheets

FLOATING ARM PICK UP DEVICE

This application claims priority from Provisional Application Ser. No. 60/452,990 filed Mar. 7, 2003 entitled "Floating Arm Pick Up Device".

BACKGROUND OF THE INVENTION

1. Field of the Invention

This invention relates to a system for adding or removing fluid from storage, and in particular to an adjustable pick up device for removing fuel from a fuel storage tank.

2. Description of the Related Art

Many problems exist when storing fuel. Fuel is an organic compound that reacts with air, water and microbiological growth. It has a relatively short shelf life and will degrade over time. Thus when fuel is stored, contaminants are formed that settle out into the fuel. The heaviest contaminants fall to the bottom of the storage tank, while lighter particles remain suspended in layers in the fuel. As a result of this stratification, less contaminated fuel remains higher in the column.

In order to maximize the usable volume of a storage tank, fuel pick up tubes are often placed within a few inches of the bottom of the tank. Having the pick up tube near the bottom allows more fuel to be withdrawn before the need to refill the tank. This can be critical, especially for emergency power systems that may have to run for long periods of time without being refueled. Yet, such a design places the pick up tube in the most contaminated area of the stored fuel.

Other storage tank features contribute to fuel contamination problems. Some storage tanks are vented to the atmosphere to relieve pressure build up. Yet, such venting introduces moisture and airborne microorganisms into the tank, which eventually make their way to the bottom of the tank due to condensation and gravity. The microorganisms grow and reproduce in this environment, living in the water while feeding on the fuel. Over time, an interface layer, that can be made up of a stringy, black mass of sediments, will form between the fuel and the water. Additional sediments also form on the tank bottom as byproducts of the microorganisms' biological processes. As a result, the pH of accumulated water drops providing a corrosive environment. If left unchecked, layers of water and sludge accumulate from the bottom, and upward toward the middle of the storage tank.

Many storage tanks also have a return fuel line through which unused fuel is discharged back into the tank. The problem of suspended sludge accumulating near the bottom of the tank is compounded when diesel engines dump fuel back into the tank through this line.

Today's expensive fuel equipment has little tolerance for such dirty, contaminated fuel. For example, the orifices on injectors are smaller to make engines more fuel efficient. Consequently, the potential for injection wear is greater when fuel is delivered from a contaminated source. Moreover, due to the present practice of introducing chemicals to the fuel through the cracking process (to increase yield), current fuel types are more dynamic, and will precipitate particles that link together to form additional sludge. The National Fire Protection Association recognizes the potential for problems associated with contaminated fuel and has provided a Standard that "fuel system design shall provide for a supply of clean fuel to the prime mover." NFPA Standard 110, 7.9.1.2.

Various attempts have been made for reducing the previously identified problems associated with stored fuel. Fuel storage tanks are typically inspected and periodically cleaned to remove the build up of contaminants. In addition, biocides or biostats can be added to the tank to destroy or inhibit the growth of microorganisms. Finally, filters can be installed and periodically changed. Because of budget constraints and differing maintenance philosophies, however, such measures are not always taken. What is needed is a fuel pick up device that will remove fuel from the cleanest part of the tank while maximizing the usable volume of a storage tank. It is to such a device that the present invention is primarily directed.

BRIEF SUMMARY OF THE INVENTION

Briefly described in a preferred form, the present invention is a pick up device for communicating fluid with the interior of a tank. The pick up device includes an intake and a submerging member for maintaining the intake a distance below the top level of the fluid inside the tank, which top level varies as the tank is filled and emptied. The submerging member can be a float that enables the intake to rise or fall in sync with the varying level of fluid in the tank. The intake can communicate with a delivery member through which the fluid can enter or exit the tank. A prevention means can prevent the intake from passing into a predetermined volume of fluid in the tank where the unacceptably contaminated fluid is found. The present invention can also include a filter for preventing filterable contaminants in the fluid from entering or exiting the pick up device.

Although the pick up device of the present invention can be used to add or remove numerous types of fluid from a tank, its use is generally contemplated for liquids that develop contaminants while in storage, and more particularly used to remove liquid fuel from a storage tank. The term fuel as used herein will be understood to mean natural or synthetic fluids that yield heat through combustion, which includes, but is not limited to, gasoline, kerosene, diesel fuel, and heating oil.

The submerging member can further include an extension connecting the delivery member to the intake. The extension can be an adjustable arm that is preferably located midway between the top and bottom of the storage tank. The adjustable arm has an intake at one end, and is connected to the delivery member at the opposite end by a sealed swivel joint. The adjustable arm can thus swivel between the middle and the bottom of the tank.

The length of the adjustable arm varies in relation to the geometry of the storage tank in order to prevent the intake from entering an unacceptably polluted or contaminated volume of fuel near the bottom of the tank when it is in its lowest position. This ensures that the maximum storage capacity of the tank is utilized without allowing the intake to drop into a contaminated volume of fuel near the bottom of the tank. An air-filled tube float located at the intake end of the adjustable arm can provide buoyancy to that end of the adjustable arm enabling it to rise and fall with variations in the top level of the fuel in the storage tank.

In proximity to the air-filled tube float can be a downturned intake connected to a filter. When the storage tank is full of fuel, the floating adjustable arm is located midway in the depth of the fuel and the plane of the adjustable arm is at least approximately parallel with the plane of the bottom of the storage tank. The arm is maintained in place by a stopping member on the swivel joint that prevents the floating adjustable arm from rising above the midway position. In this orientation, fuel is removed from the middle of the tank where it is likely the least contaminated. The invention need not include such a stop, so the arm can rise above the parallel if such is appropriate. As the fuel level in the tank falls, the swivel joint enables the adjustable arm to likewise fall. The air-filled tube float at the intake end of the adjustable arm enables the arm to float near the surface of the fuel. The downturned intake remains submerged keeping a suction point below the surface of the fuel, preventing the suctioning of contaminants floating on top of the fuel, and preventing air from entering the line.

The stopping member on the swivel joint also prevents the floating adjustable arm from extending beyond the perpendicular of the bottom of the tank as the fuel level drops due to the removal of fuel from the tank. As fuel levels are restored beyond halfway of the tank, the floating adjustable arm will return to its highest position at the midpoint of the depth of the tank where it is again preferably parallel with the bottom of the tank, if the embodiment of the invention utilizes a stopping member.

In another embodiment the adjustable arm is retractable into the delivery member, rather than connected to it by a swivel joint. The delivery member is positioned generally perpendicular to the bottom of the storage tank so that the adjustable arm retracts or extends from the delivery member in relation to the top level of fuel in the tank due to gravity and the float at the intake end of the adjustable arm. The delivery member can be positioned either above or below the adjustable arm. It is preferable, however, to position the delivery member above the adjustable arm so that the adjustable arm extends from the delivery member toward the bottom of the tank to utilize the tank's maximum storage capacity.

The present invention further provides a system that reduces the need for frequent filter replacement because the intake is prevented from entering two separate layers of the most contaminated fuel. The submerging member maintains the intake a distance below the top level of the fuel in the tank to prevent the intake from passing into a predetermined volume of contaminated fuel near the top level of fuel in the tank. Whereas the prevention means prevents the intake from entering a predefined volume of contaminated fuel at the bottom of the tank. Accordingly, the system removes the majority of the fuel from an area of the tank where the cleanest fuel is likely found.

A principle object of the present invention is to provide an innovative fluid pick up device designed for removing an uncontaminated fluid stream from a fluid storage device.

Another object of the present invention is to provide an innovative fluid pick up device designed for removing liquids that develop contaminants while in storage from the cleanest portion of the storage tank.

It is another object of the present invention to provide a fluid pick up device that removes fuel from an area of a storage tank where the cleanest fuel is found while utilizing as much storage capacity of the tank as possible.

Yet another object of the present invention is to provide a convenient alternative to frequently cleaning the storage tank that is safe, economical, and easy to use.

Still another object of the present invention is to provide a fuel pick up device that minimizes the amount of contaminated fuel delivered to fuel equipment.

Another object of the present invention is to provide a fuel pick up device that reduces the need for filter replacement.

These and other objects, features and advantages of the present invention will become more apparent upon reading the following specification in conjunction with the accompanying drawings.

DETAILED DESCRIPTION OF THE PREFERRED EMBODIMENTS

Figure 1:
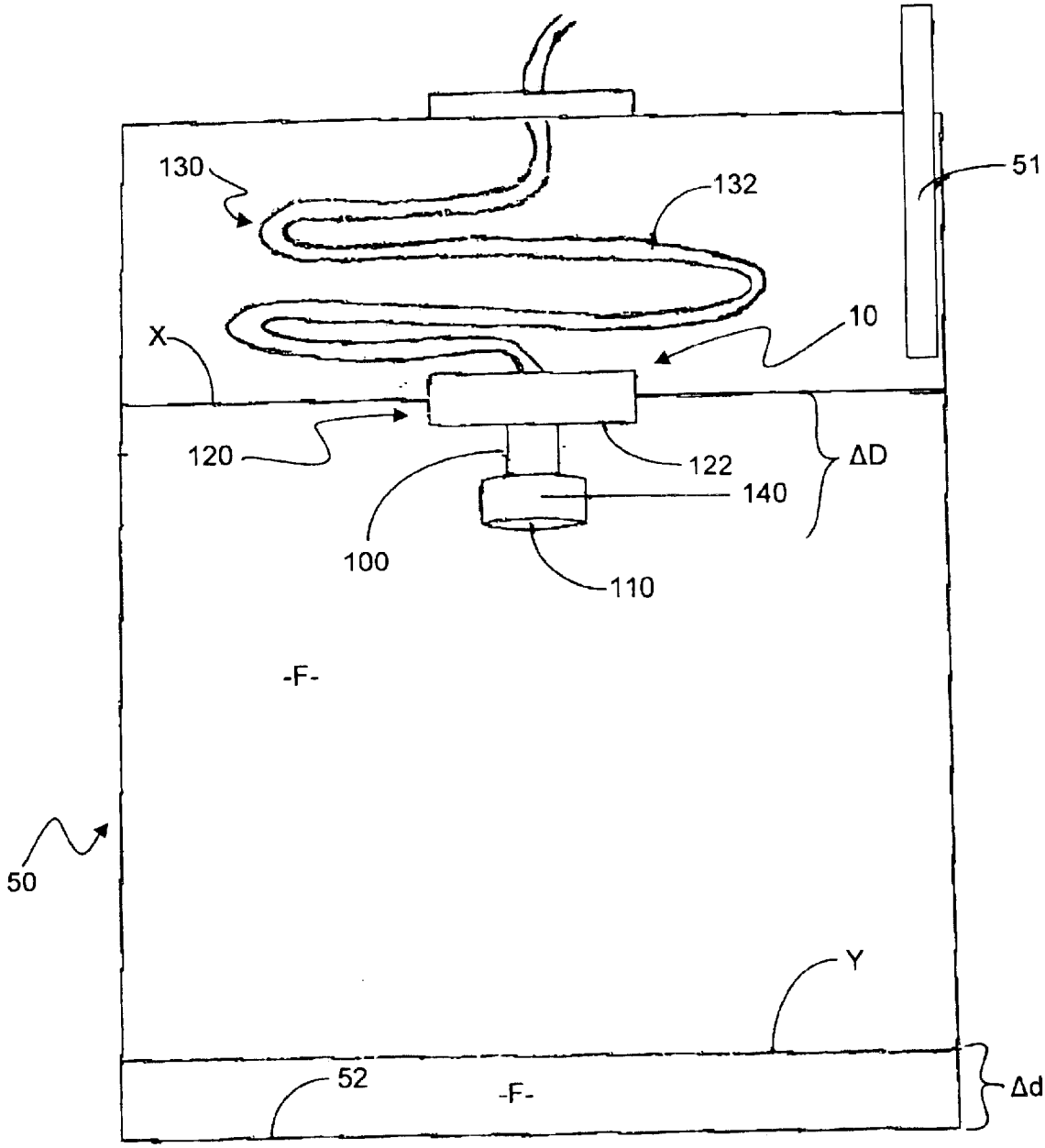
FIG. 1 is a front sectional view of a preferred embodiment of the present invention.

Referring now in detail to the drawing figures, wherein like reference numerals represent like parts throughout the several views, FIG. 1 illustrates a front sectional view of a preferred embodiment of the present invention as shown in a cut-away view of a storage tank 50. The invention is a pick up device 10 for adding or removing fluid F from inside the tank 50. Tank 50 may include a fluid replenishment line 51, in which case pick up device 10 is only used to remove fluid. In many cases, fluid F will be fuel, and thus fluid replenishment line 51 would be, for example, fuel line 51. Fuel line 51 is shown at the top of tank 50, but may be located anywhere in the tank.

In a preferred embodiment, pick up device 10 comprises an intake 110 and a submerging member 120 having an extension 100, such that intake 110 and a filter 140 remain submerged some distance $\Delta D$ below a top level X of the fuel F. The distance $\Delta D$ is defined as a varying distance from the top level of fluid F and depends on various factors such as type, size, and shape of tank 50, as well as concentration of contaminants in fuel F.

Submerging member 120 can be formed from a float material or comprise a separate float 122 that floats in relationship to the top level X of the fuel. Float 122 is in communication with extension 100, such that the intake 110 will rise and fall in relationship to the top level X of the fuel F inside the tank 50, but remain a distance $\Delta D$ below the top level X of the fluid to avoid contaminants floating on the surface of the fuel.

Extension 100 also communicates with a delivery member 130 through which the fluid F can enter or exit the tank 50. In a preferred embodiment, delivery member 130 is a flexible tube 132. The relationship between extension 100 and delivery member 130 can form a prevention means, such that intake 110 remains above a prescribed lower level Y of fuel F in the tank 50, as the fuel within a volume defined by lower level Y and the bottom 52 of tank 50 can be the most contaminated due to settled contaminants. Lower level Y is defined as a varying distance $\Delta d$ above the bottom 52 of tank 50, and depends on various factors such as type, size and shape of tank 50 as well as concentration of contaminants in fluid F. Preferably, Δd is at least six inches from the bottom 52 of the tank 50 and more preferably in the range of six to eight inches. The prevention means is adjustable by adjusting the length of delivery member 130 and/or the length of extension 100, preventing intake 110 from passing into the volume of contaminated fuel F below lower level Y. A person of ordinary skill in the art, however, will recognize that changes in size, shape, or rearrangement of extension 100 and the delivery member 130 to one another will also accomplish this goal and may be necessary for individual storage tanks.

FIG. 1 further shows a filter 140 for intake 110 that is capable of filtering the fuel F moving through filter 140. Filter 140 can be of several sizes or shapes, but is preferably a screen or mesh filter of at least 100 microns. The 100 micron size is necessary to prevent particles of contaminant from stopping up pick up device 10.

Figure 2:
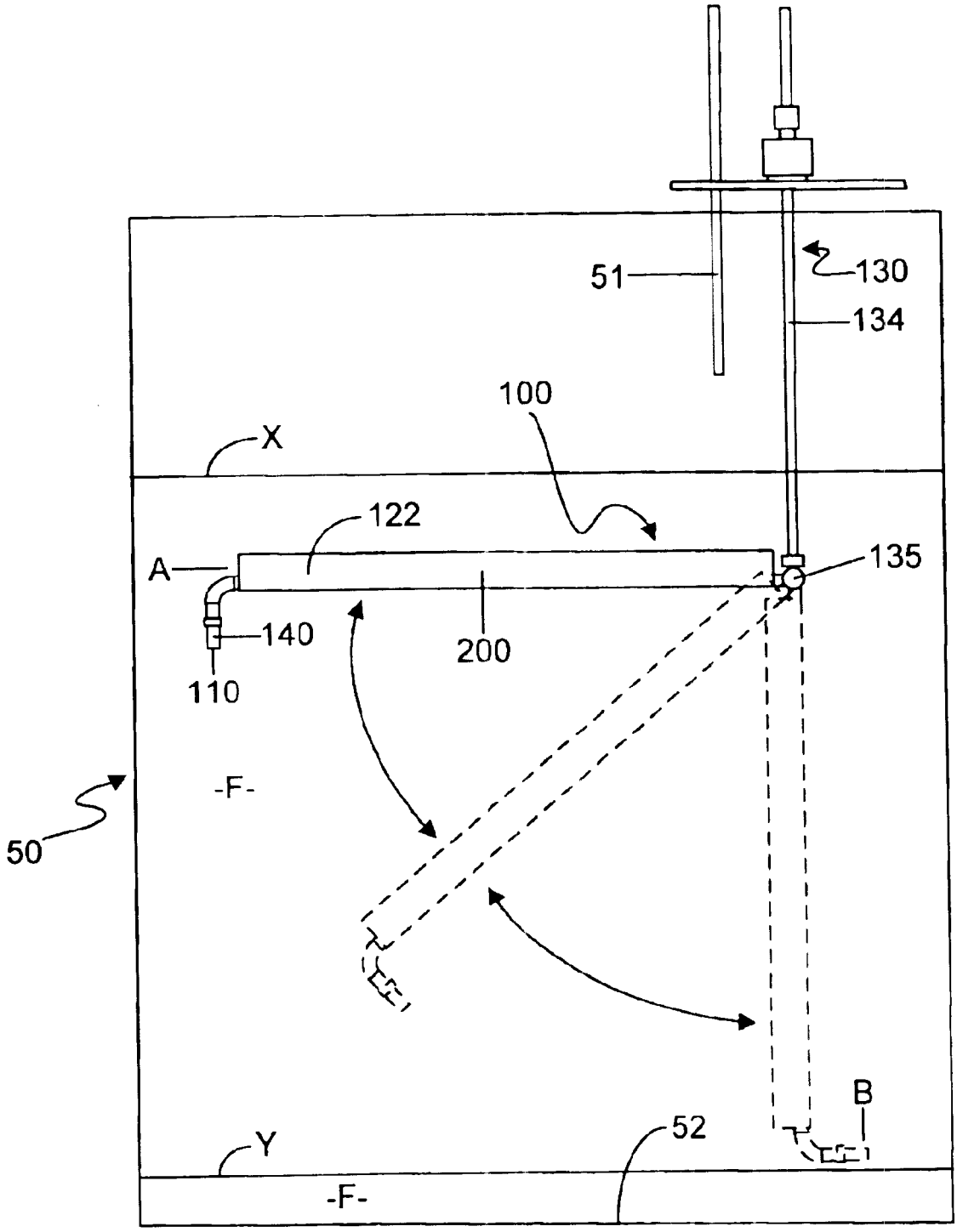
FIG. 2 is a front sectional view of another embodiment of the present invention illustrating the adjustable arm moving between first and second positions.
Figure 3:
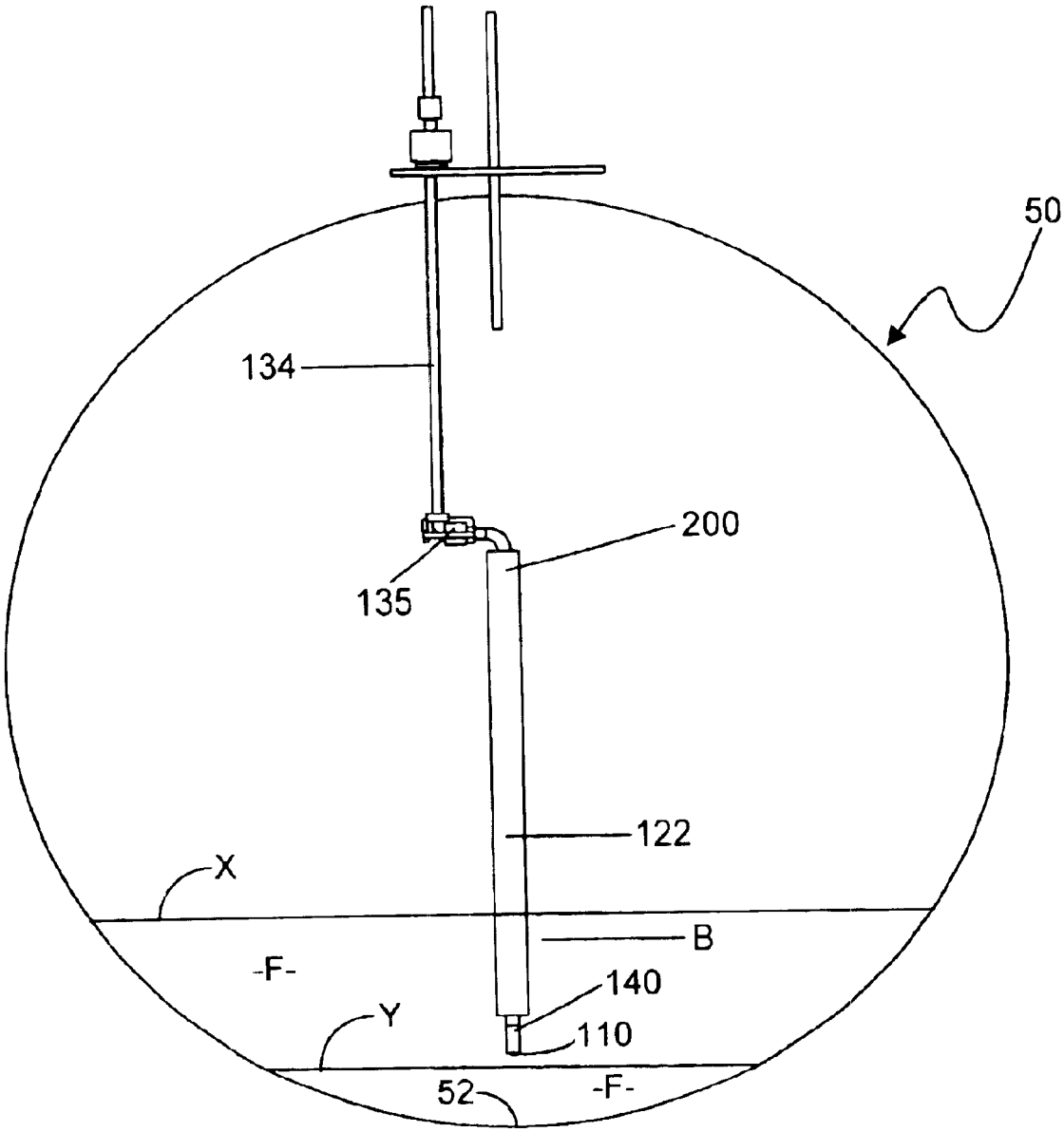
FIG. 3 is a side view of the embodiment in FIG. 2 showing the adjustable arm in the second position.

FIGS. 2 and 3 illustrate front and side sectional views, respectively, of an alternative embodiment of the present invention. In FIG. 2, extension 100 is an adjustable arm 200 that is rotationally movable between a first position A that is relatively distal to the bottom 52 of the tank 50, and a second position B that is relatively proximal to the bottom 52 of the tank 50. In this embodiment, delivery member 130 can be a non-flexible straight tube 134. The base end of adjustable arm 200 is shown connected to tube 134 through a swivel joint 135. When adjustable arm 200 is in the first position A, it is generally parallel to the bottom 52 of the tank 50 and when it is in the second position B, it is generally perpendicular to the bottom 52 of the tank 50.

Adjustable arm 200 is preferably confined to the range of motion between positions A and B by a stopping member 150 (FIGS. 4 and 5), although adjustable arm 200 need not be so confined, and could swivel beyond 90° if the swivel joint 135 does not incorporate a stopping member to so inhibit rotation. The prevention means of this embodiment can comprise a predefined length of arm 200, wherein the length of adjustable arm 200 preferably is set so that intake 110 does not pass into volume Y of the fuel. A filter 140 is also shown on the free end of adjustable arm 200 with a float 122 positioned between filter 140 and the base end of adjustable arm 200. Alternatively, the arm 200 can be formed of a floatable material such that an additional float 122 element need not be necessary.

FIG. 3 is a side sectional view showing adjustable arm 200 in the second position B and connected to tube 134 through swivel joint 135. As shown the top level X of fuel F has fallen in the tank 50, and thus adjustable arm 200 has moved to position B. Float 122 maintains intake 110 submerged below top level X when adjustable arm 200 is in position B, while the length of adjustable arm 200 prevents intake 110 from entering the volume of fuel below lower level Y. Filter 140 is also included to filter out contaminants in the fluid F.

Figure 4:
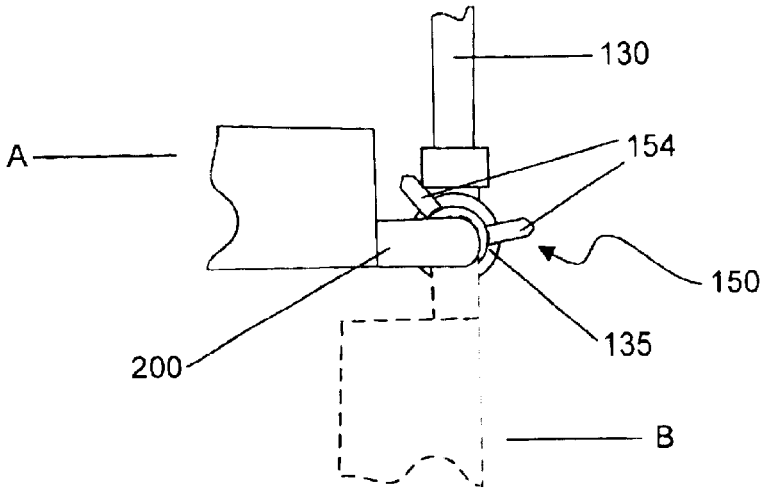
FIG. 4 is a front view showing a preferred stopping member of the present invention.
Figure 5:
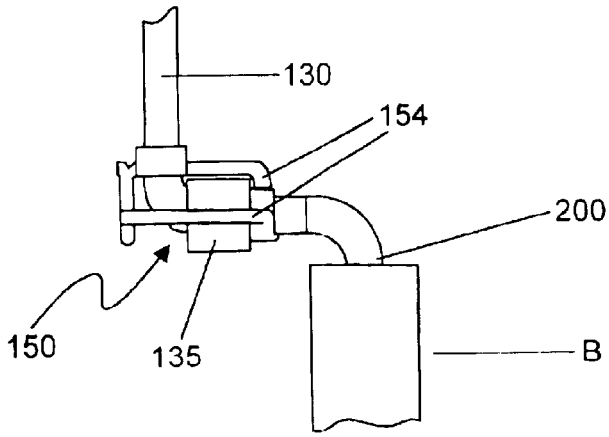
FIG. 5 is a side view of the stopping member shown in FIG. 4.

FIGS. 4 and 5 illustrate the stopping member 150 of the present invention. A front view of stopping member 150 is shown in FIG. 4. An embodiment of stopping member 150 includes a pair of rods 154 in communication with swivel joint 135. The rods 154 are shown aligned parallel with the length of swivel joint 135 and are preferably set apart from one another at an angle of 90° or greater. Accordingly, one of the rods prevents the adjustable arm 200 from passing beyond the second position B in its downward pass when the top level X of the fuel F in the tank drops (FIG. 5), while the other rod prevents the adjustable arm 200 from rising above the first position A when the top level X of the fuel F rises due to fuel being added to the tank (FIG. 4). The relative angle between rods 154 can be adjustable so that the range of motion of adjustable arm 200 can be altered accordingly. Alternatively, stopping member 150 may comprise welded stops (not shown) that confine the range of motion of adjustable arm 200, or a combination of welded stops and at least one rod (not shown).

Figure 6:
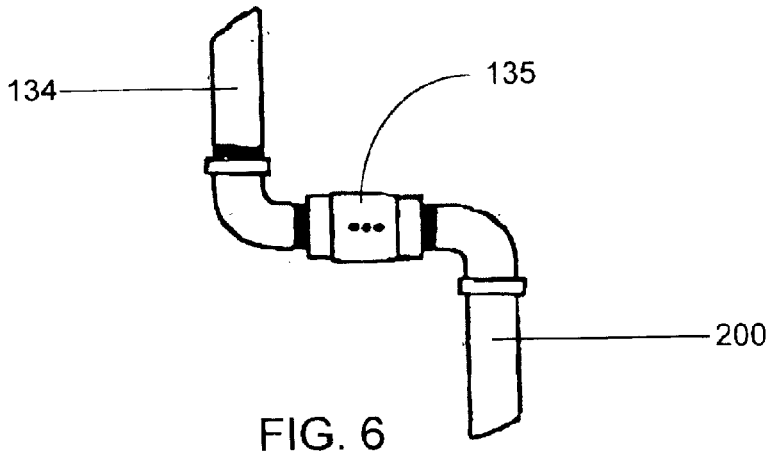
FIG. 6 is side view of the swivel joint of the embodiment shown in FIGS. 2 and 3.

FIG. 6 is a side view of a swivel joint of the embodiment shown in FIGS. 2 and 3 with the stopping member removed. Swivel joint 135 is shown connecting adjustable arm 200 to tube 134. Swivel joint 135 is sealed to ensure that fuel passes efficiently between adjustable arm 200 and tube 134. Although adjustable arm 200 and tube 134 are shown joined to swivel joint 135 by individual 90° elbows, a person of ordinary skill in the art will recognize that they may be joined directly to swivel joint 135 and need not be at a 90° angle.

Figure 7:
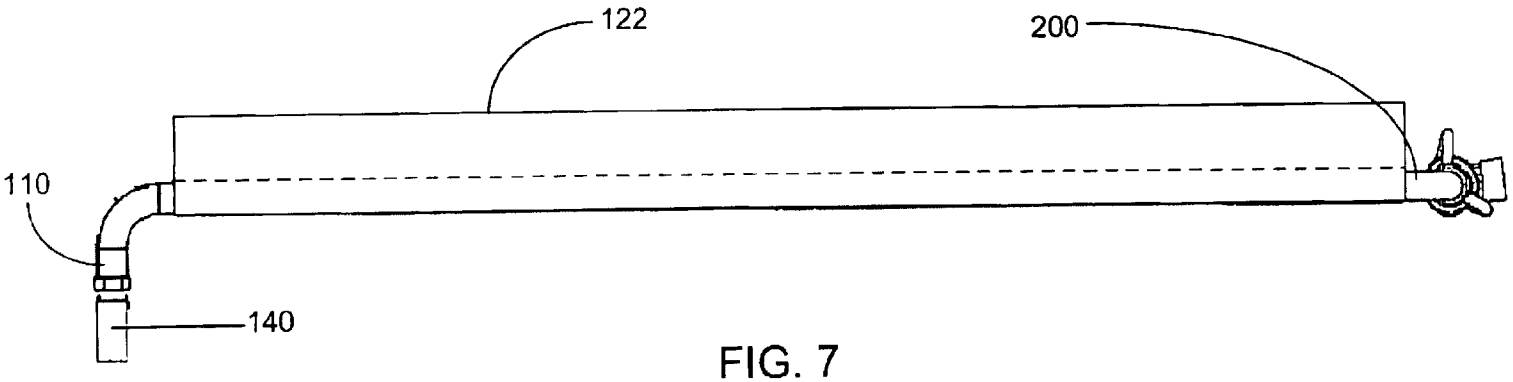
FIG. 7 is a front view showing the float and filter of the embodiment shown in FIGS. 2 and 3.

The float and filter of the arm 200 shown in FIGS. 2 and 3 are illustrated in FIG. 7. Intake 110 is also shown positioned between the float 122 and filter 140. In addition, the intake 110 is angled downwardly in relation to the end of the adjustable arm 200. Although intake 110 is shown perpendicular to adjustable arm 200, intake 110 need only be angled or downturned enough for it to remain submerged when the top level of fuel has dropped enough for adjustable arm 200 to float. In a preferred embodiment, float 122 is a tube float carried by adjustable arm 200 and can be made of buoyant materials. Float 122 can also be several sizes or shapes as long as it is buoyant enough to enable adjustable arm 200 to rise and fall along with the level of fuel in the tank.

Figure 8:
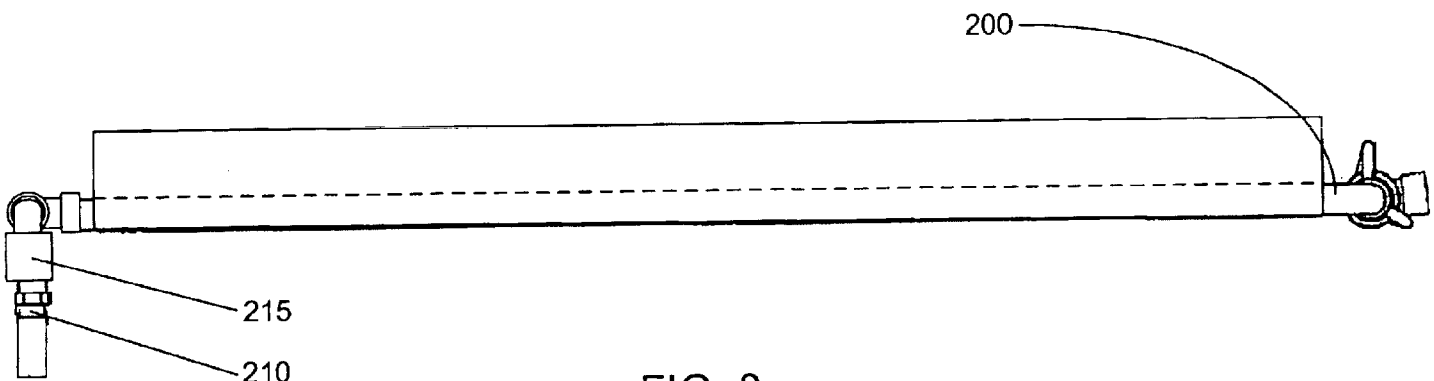
FIG. 8 is a front view showing a preferred movable intake of another embodiment of the present invention.

FIG. 8 is a front view of a movable intake of another embodiment of the present invention. In FIG. 8, the intake 210 is movable in relation to adjustable arm 200. Intake 210 includes a weighted member 215 that enables intake 210 to point toward the bottom of the storage tank as adjustable arm 200 moves between positions A and B (FIG. 2).

Figure 9:
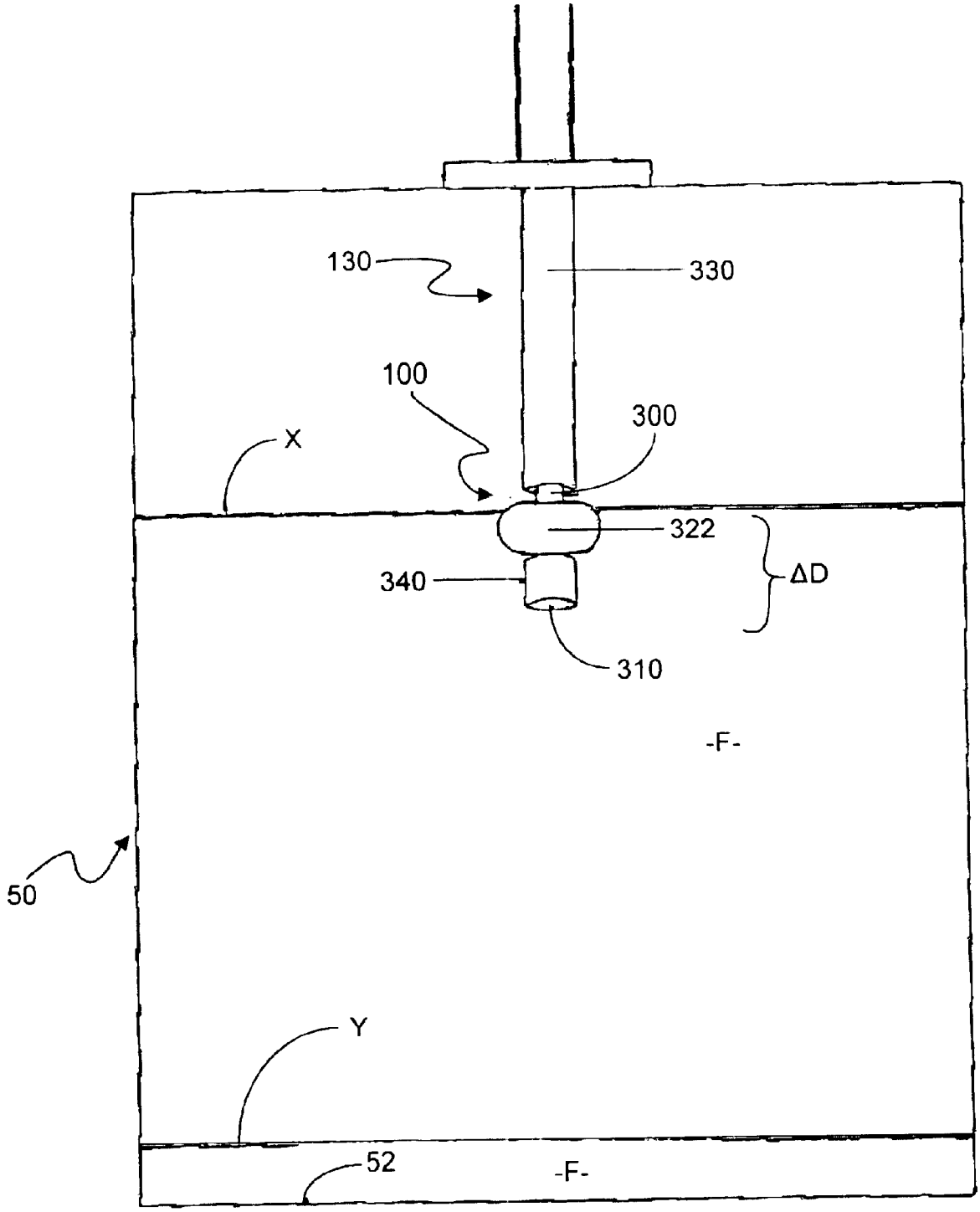
FIG. 9 is a front sectional view of yet another embodiment of the present invention showing the adjustable arm in the retracted position.

A front view of yet another embodiment of the present invention is shown in FIG. 9. In this embodiment, extension 100 includes an adjustable arm 300 that is telescoping with delivery member 130. Delivery member 130 can be a straight tube 330 adapted to receive adjustable arm 300 within it. Adjustable arm 300 includes an intake 310, a float 322, and a filter 340. Gravity and float 322 enable adjustable arm 300 to extend from or retract into delivery member 330 in relationship to a top level X of fuel F in a storage tank 50, while keeping intake 310 submerged a distance ΔD below top level X.

Figure 10:
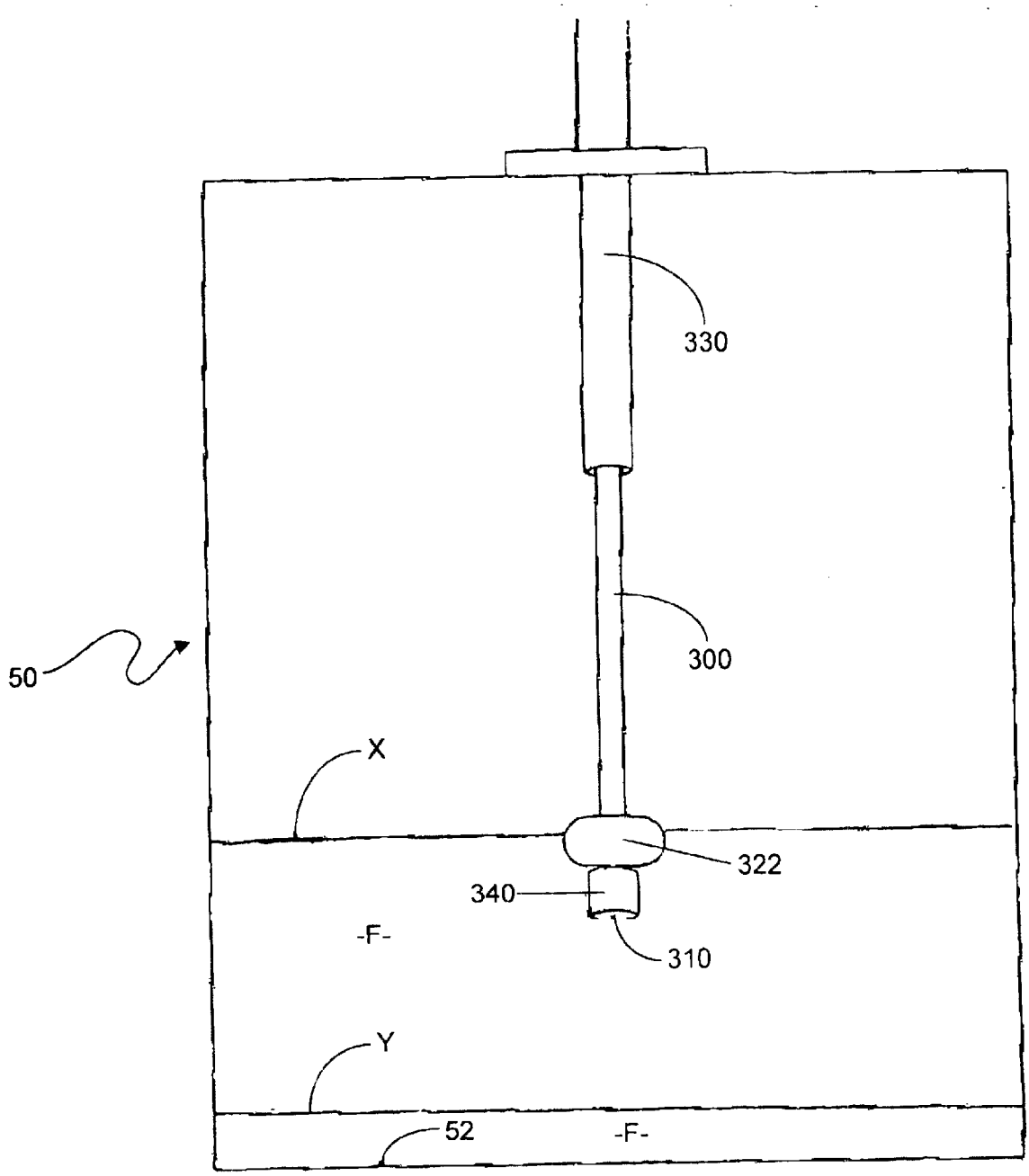
FIG. 10 is a front sectional view of the embodiment in FIG. 9 showing the adjustable arm in the extended position.

FIG. 10 is a front view of the embodiment in FIG. 9 showing the adjustable arm in an extended position. As the top level X of fuel F in storage tank 50 drops, adjustable arm 300 extends from delivery member 330 and moves toward the bottom 52 of the storage tank 50 due to gravity. When adjustable arm 300 is fully extended, intake 310 is prevented from entering the volume of fuel F below level Y to prevent picking up contaminated fuel F. Filter 340 is also included to filter out contaminants from fuel F. When fuel F is again added to the tank and top level X rises, adjustable arm 300 will rise along with the fuel F via float 322 and retract into delivery member 330 as shown in FIG. 9.

The pick up device of the present invention is preferably constructed of non-corrosive materials. The delivery member, extension, and intake can be made of, for example, carbon steel or aluminum alloy. The elements can also include plastic parts specifically on the float, preferably as such plastics are non-reactive and impervious to the stored fuel. Although the present invention is suitable for several types of storage tanks, it is best suited for use with stationary tanks including vertical, horizontal, oblong, belly, aboveground, and underground storage tanks. Storage tank capacity will typically range from 50 to 50,000 gallons and larger tanks may be custom fitted.

Generally, the basic formula for fitting the device to individual tanks is the height of the tank (or diameter of the end of an oblong tank viewed from the side), minus at least six to eight inches, divided by two. Such a calculation may be used to identify the middle layer of fluid for placement of the adjustable arm when the tank is full. The delivery member should extend toward this middle layer such that the adjustable arm rests near this middle layer or higher when the adjustable arm is at its highest position in the tank. Such positioning allows for removal of fluid from an area of the tank that is least likely contaminated. The six to eight inches subtracted from the above measurement accounts for the preferable distance between the intake and the bottom of the tank when the adjustable arm is fully extended. Floating the adjustable arm depends on the length of the arm, the weight of the material used, and the buoyancy of the float. The delivery member is also preferably offset from center at least proportionate to the length of the swivel joint so that the adjustable arm is substantially in the vertical center of the tank when it is fully extended.

Numerous characteristics and advantages have been set forth in the foregoing description, together with details of structure and function. While the invention has been disclosed in its preferred forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A pick up device for a tank with fluid, the tank having a bottom and wall, the pick up device comprising:

an intake;

a submerging member in communication with the intake for maintaining the intake a distance below the top level of the fluid inside the tank to prevent the intake from passing into a predetermined volume of contaminated fluid near the top level of fluid in the tank;

an adjustable stopping member for adjustably controlling the rotational range of movement of the submerging member, the adjustable stopping member limiting the rotational range of movement of submerging member from rising above an orientation parallel to the tank bottom, the adjustable stopping member distal the wall of the tank, free of connecting with the wall of the tank; and a prevention means for preventing the intake from entering a predefined volume of contaminated fuel at the bottom of the tank.

2. The pick up device of claim 1, wherein the submerging member comprises a float extending along least a portion of the submerging member.

3. The pick up device of claim 1 further comprising an adjustable length delivery member in communication with the intake and adapted for transporting the fluid between an inside and an outside of the rank.

4. The pick up device of claim 3 further comprising a filter for filtering the fluid, and a swivel joint connecting the submerging member with the delivery member, the swivel joint distal the wall of the tank, free connection with the wall of the tank.

5. The pick up device of claim 3, wherein the submerging member further comprises an extension member connecting the delivery member to the intake.

6. The pick up device of claim 5, wherein the extension member comprises an adjustable arm having a base end and a free end, wherein the free end communicates with the intake and the base end is adapted to communicate with the delivery member.

7. The pick up device of claim 6, wherein the adjustable arm has a predetermined length and is movable between a first position distal to the bottom of the tank and a second position proximal to the bottom of the tank.

8. The pick up device of claim 7, wherein the prevention means comprises the predetermined length of the adjustable arm.

9. The pick up device of claim 8, further comprising a float extending along at least a portion of the submerging member, wherein the float is in communication with the adjustable arm, such that the free end of the adjustable arm moves between the first and second positions in sync with the varying top level of the fluid inside the tank.

10. The pick up device of claim 9, wherein the base end of the adjustable arm is connected to the delivery member by a swivel joint.

11. The pick up device of claim 10, further comprising a stopping member for controlling the range of movement of the adjustable arm, such that the adjustable arm is generally parallel to the bottom of the tank when in the first position and generally perpendicular to the bottom of the tank when in the second position.

12. The pick up device of claim 11, wherein the stopping member comprises:

a pair of rods in communication with the swivel joint.

13. The pick up device of claim 12, wherein the intake is perpendicular to the free end of the adjustable arm.

14. The pick up device of claim 9, wherein the intake is movable in relationship to the adjustable arm.

15. The pick up device of claim 14, wherein the intake further comprises a weighted member, such that the intake remains directed toward the bottom of the tank when the adjustable arm moves between the first and second positions.

16. The pick up device of claim 9, wherein the adjustable arm is retractable into the delivery member, such that the adjustable arm retracts or extends between the first position and the second position in sync with the varying top level of the fluid in the tank.

17. The pick up device of claim 1, further comprising a flexible delivery member in communication with the intake and adapted for transporting the fluid between an inside and an outside of the tank.

* * * * *